US009156587B2

(12) United States Patent
Saunders et al.

(10) Patent No.: US 9,156,587 B2
(45) **Date of Patent: *Oct. 13, 2015**

(54) MULTIPLE SEALED BEVERAGE VESSELS IN A CASE

(71) Applicant: NOTTINGHAM SPIRK PARTNERS LLC, Cleveland, OH (US)

(72) Inventors: Craig Saunders, Rocky River, OH (US); John Evan Spirk, Gates Mills, OH (US); Jeffrey Kalman, Cleveland Heights, OH (US); Jens P. Johnson, Cleveland, OH (US)

(73) Assignee: Nottingham Spirk Partners LLC, Cleveland, OH (US)

( * ) Notice: Subject to any disclaimer, the term of this patent is extended or adjusted under 35 U.S.C. 154(b) by 95 days.

This patent is subject to a terminal disclaimer.

(21) Appl. No.: 13/671,716

(22) Filed: Nov. 8, 2012

(65) Prior Publication Data

US 2013/0062238 A1 Mar. 14, 2013

Related U.S. Application Data

(63) Continuation of application No. 13/071,117, filed on Mar. 24, 2011, now Pat. No. 8,328,014, which is a continuation of application No. 12/750,376, filed on Mar. 30, 2010, now abandoned.

(60) Provisional application No. 61/187,475, filed on Jun. 16, 2009, provisional application No. 61/244,100, filed on Sep. 21, 2009, provisional application No. 61/261,434, filed on Nov. 16, 2009.

(51) Int. Cl.

| | |
|---|---|
| ***B65D 71/06*** | (2006.01) |
| ***B65D 21/00*** | (2006.01) |
| ***B65D 77/04*** | (2006.01) |
| ***B65D 77/20*** | (2006.01) |

(52) U.S. Cl.

CPC ..... *B65D 21/00* (2013.01); *B65D 77/0486* (2013.01); *B65D 77/2024* (2013.01)

(58) Field of Classification Search

USPC ..... 206/427, 429, 430, 431, 428, 433, 435, 206/499, 503, 508, 585, 775–778, 782, 206/426; 211/74

See application file for complete search history.

(56) References Cited

U.S. PATENT DOCUMENTS

| | | | |
|---|---|---|---|
| 3,006,461 | A | 10/1961 | McGinnis |
| 3,198,327 | A | 8/1965 | Boehling et al. |
| 4,610,349 | A | 9/1986 | Schwartz et al. |
| 4,681,225 | A | 7/1987 | Schuster |

(Continued)

*Primary Examiner* — Anthony Stashick
*Assistant Examiner* — Robert Poon
(74) *Attorney, Agent, or Firm* — Rankin, Hill & Clark LLP

(57) ABSTRACT

A consumer packaged good includes a case, a plurality of translucent vessels vertically stacked within the case, a beverage stored in each of the plurality of the vessels and a barrier sealed to each vessel for containing the beverage in the respective vessel. The case includes a base wall and at least one side wall extending upwardly from the base wall. The plurality of translucent vessels are surrounded by the sidewall. Each vessel includes an opening for drinking from the vessel and a base surface for supporting the vessel on an associated support surface. The barrier seals to each vessel for covering the opening and containing the beverage in the respective vessel. The barrier is peelable from the vessel without destroying the vessel to provide access to the beverage stored in the vessel.

20 Claims, 9 Drawing Sheets

(56) References Cited

U.S. PATENT DOCUMENTS

| | | | | |
|---|---|---|---|---|
| 5,279,841 | A | 1/1994 | Yu | |
| D403,957 | S | 1/1999 | Bright et al. | |
| 6,820,743 | B2 * | 11/2004 | Hurley et al. | 206/427 |
| D551,502 | S | 9/2007 | Bodum | |
| 2001/0032795 | A1 * | 10/2001 | Weinstein et al. | 206/321 |
| 2005/0092759 | A1 | 5/2005 | Willat et al. | |
| 2005/0139570 | A1 * | 6/2005 | Lambert et al. | 215/223 |
| 2006/0032855 | A1 * | 2/2006 | Hinkle | 220/703 |
| 2008/0011748 | A1 | 1/2008 | Meyer et al. | |
| 2008/0023348 | A1 * | 1/2008 | Herzog et al. | 206/217 |
| 2008/0302692 | A1 | 12/2008 | Dubosq et al. | |
| 2010/0072095 | A1 | 3/2010 | Salovaara | |
| 2010/0163559 | A1 * | 7/2010 | Towers | 220/254.1 |

* cited by examiner

MULTIPLE SEALED BEVERAGE VESSELS IN A CASE

BACKGROUND

Storing an opened bottle of wine when the entire contents of the bottle have not been consumed presents an issue. Air coming into contact with wine begins to degrade the wine. Many complicated mechanisms have been developed to remove air from within the wine bottle and to reseal the bottle.

Because it is difficult to reseal a bottle of wine to properly preserve the wine, other products have been developed to allow wine drinkers to consume less than an entire 750 ml (or larger) bottle of wine. For example, wine is shipped in a bag surrounded by a rigid box. The bag includes a spout and when wine is dispensed from the bag through the spout, air does not enter the bag; therefore, the degradation issues of the air coming into contact with the wine are mitigated. These known bags of wine require separate glasses into which the wine is poured. Moreover, some wine consumers consider the bag of wine within the box to be unattractive.

Wine is also shipped in bottles that are less than 750 ml. For example, four smaller bottles of wine are shipped in a four-pack. A total volume of wine in the four-pack is 750 ml. This four-pack, however, requires more shelf space than a typical 750 ml bottle of wine. Additionally, the known four-pack requires a separate glass into which to pour the wine, unless the consumer plans to drink the wine directly from the small bottle.

SUMMARY

An example of a consumer packaged good that could overcome at least some of the aforementioned shortcomings includes a case, a plurality of translucent vessels vertically stacked within the case, wine stored in each of the plurality of the vessels and a barrier sealed to each vessel for containing the wine in the respective vessel. The case includes a translucent portion and has a base wall and at least one side wall extending upwardly from the base wall. The plurality of translucent vessels are surrounded by the sidewall. Each vessel includes an opening for drinking from the vessel and a base surface for supporting the vessel on an associated support surface. Each vessel defines a vertical axis extending through a center of the opening and normal to the base surface. The barrier seals to each vessel for covering the opening and containing the wine in the respective vessel. The barrier is peelable from the vessel without destroying the vessel to provide access to the wine stored in the vessel.

Each barrier and each vessel can be configured to support at least three vertically stacked vessels, each storing 187 ml of wine without the barrier unsealing from the vessel. Each vessel can include a generally circular base and a vessel side wall extending upwardly from the base having an upper edge defining the opening, which can be generally circular. The generally circular opening can be larger than the generally circular base and each barrier can seal to the sidewall of the vessel in a manner to support at least three vertically stacked vessels, each storing 187 ml of wine without the barrier unsealing from the vessel where the upper edge of a lower vessel is radially spaced from the base of a respective vessel supported by the barrier of the lower vessel. If desired, a plurality of supports can be disposed between adjacent vessels where each support contacts the upper edge and the base of adjacent vessels.

The plurality of translucent vessels can store a total volume of wine equal to at least one of 750 ml, 1.5 liters and 3 liters.

As mentioned above, each vessel can store about 187 ml of wine. Each vessel can also be shaped similarly to a conventional stemless glass of wine.

The plurality of vessels can include at least four vessels vertically stacked in the case. The sidewall of the case can extend upwardly from the base wall less than about 13 inches. Also, the base wall can have a maximum dimension about equal to or less than the maximum diameter of a conventional 750 ml of wine.

Alternatively, the plurality of vessels can include at least two stacks of four vessels each, and the sidewall of the case can extend upwardly from the base wall less than about 13 inches. In such an arrangement, the base wall can have a maximum dimension about equal to or less than six inches. Also, the at least two stacks can include a first stack of vessels each storing red wine and a second stack of vessels each storing white wine.

In another configuration, the plurality of vessels can include at least two layers of eight vessels each including an upper layer stacked on a lower layer. In such an arrangement, the at least one side wall can include four side walls, each extending upwardly from a peripheral edge of the base wall. At least one side wall having a surface area less than or equal to the remaining side walls can be attached to at least one of the remaining side walls or the base wall in a manner to allow detachment of the at least one side wall for providing access to the vessels.

Another example of a consumer packaged good that can overcome at least some of the aforementioned shortcomings includes a case, a plurality of translucent vessels vertically stacked within the case, wine stored in each of the plurality of vessels, and a barrier sealed to each vessel for containing the wine in the respective vessel. The case has a base wall and a side wall extending upwardly from the base wall less than about 13 inches. The base wall has a maximum dimension of less than six inches and a second dimension taken perpendicular to the maximum dimension that is less than about 3.5 inches. The side wall of the case can include a translucent portion. The plurality of vessels that are vertically stacked within the case are surrounded by the side wall. Each vessel is shaped similarly to a conventional stemless wine glass and includes an opening for drinking from the vessel and a base surface for supporting the vessel on an associated support surface. Each vessel defines a vertical axis extending through a center of the opening and normal to the base surface. A total volume of within with the case can be 750 ml, 1.5 liters or 3 liters. Each barrier seals to a respective vessel for covering the opening and containing the wine in the respective vessel. The barrier is peelable from the vessel without destroying the vessel to provide access to the wine stored in the vessel.

Another example of a consumer packaged good that can overcome at least some of the aforementioned shortcomings includes a translucent case, a plurality of translucent vessels including an upper layer of vessels vertically stacked on a lower layer of vessels within the case, about 187 ml of wine stored in each of the plurality of vessels, and a barrier sealed to each vessel for containing the wine in the respective vessel. The translucent case includes a base wall, four side walls extending upwardly from the base wall, and a top wall. The case has a maximum dimension less than about 12 inches and a second dimension taken perpendicular to the maximum dimension being less than about six inches. A smaller sidewall of the four side walls is releasably connected with at least one of the other side walls, the base wall or the top wall for providing access to inside the translucent case. Each vessel is shaped similarly to a conventional stemless wine glass and includes a generally circular opening for drinking from the vessel and a base surface for supporting the vessel on an associated support surface. Each vessel defines a vertical access extending through a center of the opening and normal to the base surface. The barrier seals to each vessel for covering the opening and containing the wine in the respective vessel. The barrier is peelable from the vessel without destroying the vessel to provide access to the wine stored in the vessel.

DETAILED DESCRIPTION

Figure 1:
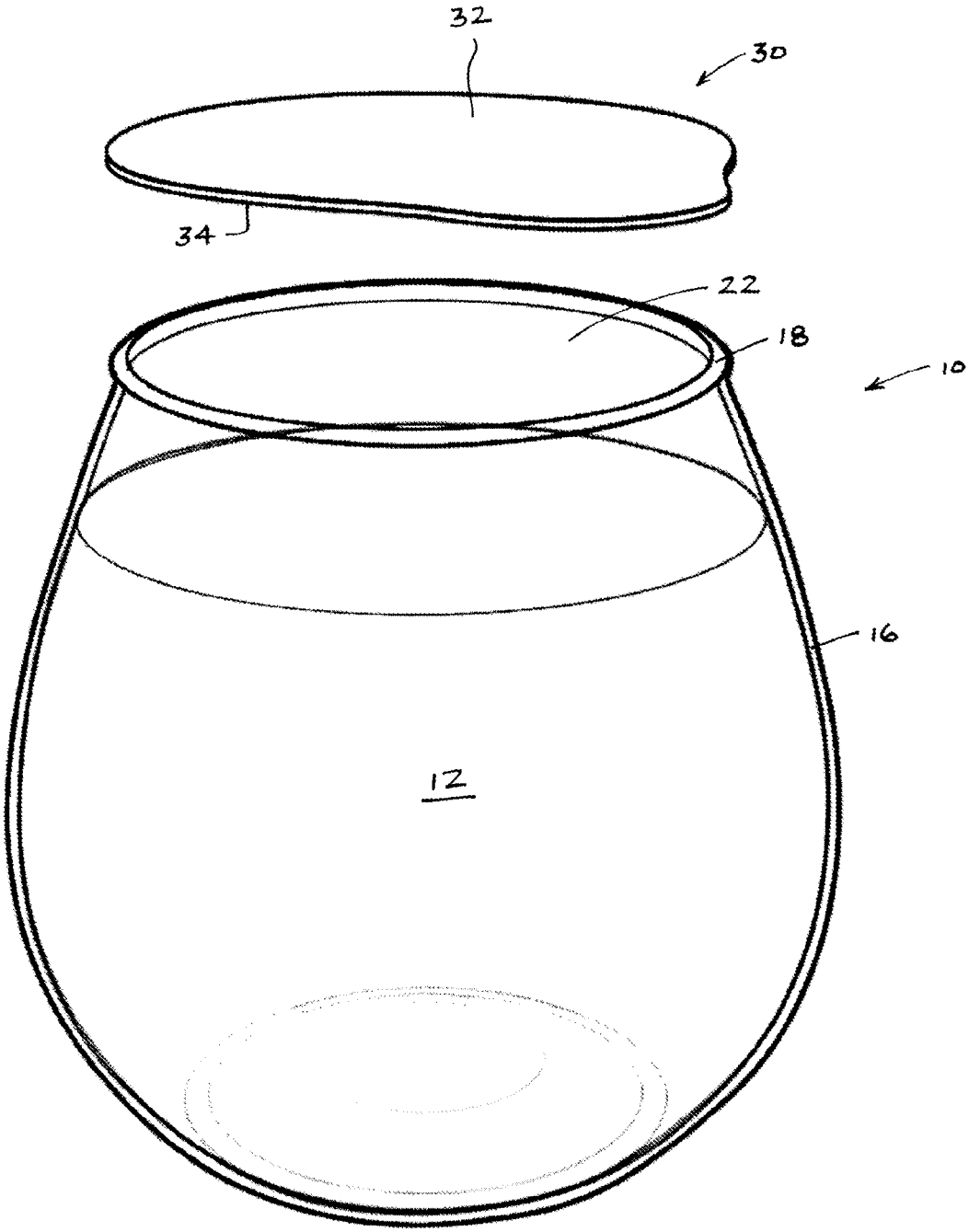
FIG. 1 is a perspective view of a vessel and a barrier that can seal to the vessel. The vessel and barrier can make up a sealed vessel that can be sold as a consumer packaged good.

The descriptions and drawings herein are merely illustrative and various modifications and changes can be made in the structures disclosed without departing from the scope of the appended claims. All references to direction and position, unless otherwise indicated, refer to the orientation of the embodiments illustrated in the drawings and should not be construed as limiting the appended claims. Like numerals refer to like parts throughout the several views.

With reference to FIG. 1, a vessel 10 for storing a beverage 12, such as wine, is disclosed. The vessel depicted in FIG. 1 is shaped similarly to a conventional stemless wine glass, which allows the vessel when packaged in a consumer packaged good (described in more detail below) to provide an attractive vessel for drinking the wine 12. The vessel can take other conventional drinking glass shapes as well, e.g. an apertiff glass, a cordial glass, a martini glass, a brandy glass, a highball glass and a margarita glass. The vessel 10 can be made from a translucent and/or transparent material, e.g. plastic or glass, which allows a consumer and others to view the contents of the vessel 10.

The illustrated vessel 10 includes a generally circular base 14 and a vessel side wall 16 extending upwardly from the base. The vessel side wall 12 has an upper edge 18 defining an opening 22 for drinking from the vessel 10. The opening 22 is generally circular in the depicted embodiment. Since the vessel 10 provides a package for the wine 12 and also provides a vessel from which the wine can be consumed, e.g. the wine 12 need not be poured into another wine glass, the opening 22 can be large enough, e.g. about two inches or greater in diameter, so that a consumer of the wine can stick his or her nose in the opening while his or her lips are around the upper edge 18. This configuration provides an attractive vessel from which to drink the wine 12 similar to a conventional wine glass.

Figure 2:
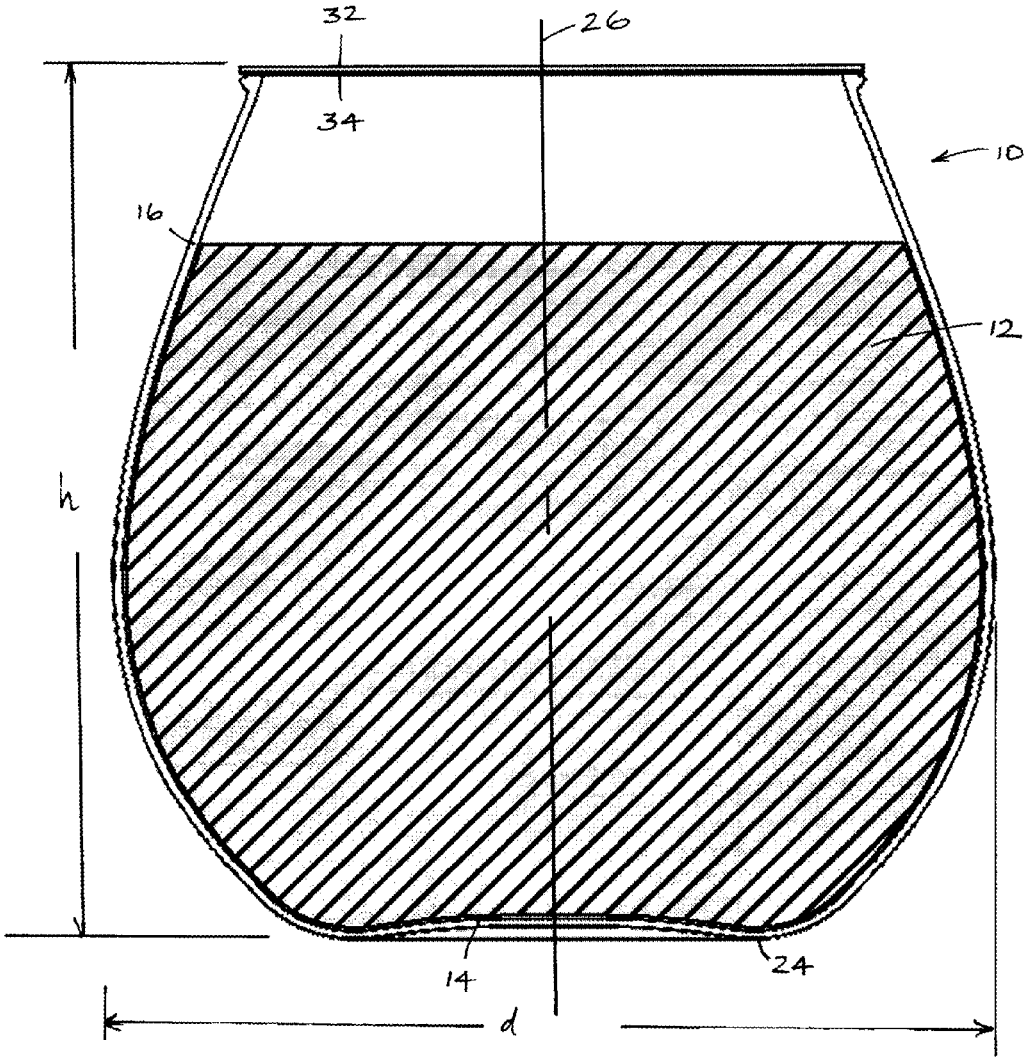
FIG. 2. is a schematic cross-sectional view of the vessel and barrier depicted in FIG. 1.

With reference to FIG. 2, the vessel 10 also includes a base surface 24, which would be generally annular for the vessel 10 depicted in FIG. 1, for supporting the vessel 10 on an associated support surface such as a table or countertop. The vessel 10 also defines a vertical axis 26 extending through a center of the opening 22 and normal to the base surface 24. The side wall 16 is curved in a cross section taken normal to the base surface 24 and the side wall revolves around the vertical axis 26. In the illustrated embodiment, the generally circular opening 22 is larger than the generally circular base 14; however, the vessel 10 can take other configurations. Generally, the diameter of the opening 22 will be smaller than a greatest diameter d of the vessel measured perpendicular to the vertical axis 26. The greatest diameter d of the vessel 10 in the illustrated embodiment is less than three inches, and more particularly about 2.8 inches, which allows a consumer packaged good (described in more detail below) to occupy the same or a similar amount of retail shelf space as a conventional 750 ml bottle of wine (see FIG. 4). The vessel 10 also has a maximum height h, measured parallel to the vertical axis 26, that is less than three inches, and more particularly about 2.8 inches. This also allows a consumer packaged good (described in more detail below) to occupy the same or a similar amount of retail shelf space as a conventional 750 ml bottle of wine (see FIG. 4).

A barrier 30 seals to the vessel 10 for covering the opening 22 and containing the wine 12 in the vessel. The barrier 30 is peelable from the vessel 10 without destroying the vessel to provide access to the wine 12 stored in the vessel. In the illustrated embodiment, the barrier 30 is a generally disc-like structure having a planar upper surface 32 and a planar lower surface 34, which contacts the upper edge 18 of the sidewall 12 of the vessel 10. The barrier can be made from a film. The vessel 10 and the barrier 30 are each made from materials that are suitable for allowing the barrier 30 to attach to the upper edge 18 by a conventional heat sealing method where the upper edge 18 is heated and the barrier 30 is affixed to the heated upper edge. The barrier 30 can attach to the vessel 10 in other conventional manners; however, it is desirable that the barrier 30 be peelable or removable from the vessel without damaging the upper edge 18 of the vessel so that one can consume the wine 12 within the vessel 10 from the vessel, as opposed to pouring the wine into another wine glass. With the barrier 30 removed from the vessel 10 and the vessel being shaped similarly to a conventional stemless wine glass, a consumer can be provided a single serving of wine in an attractive vessel from which the consumer can drink the wine.

Figure 3:
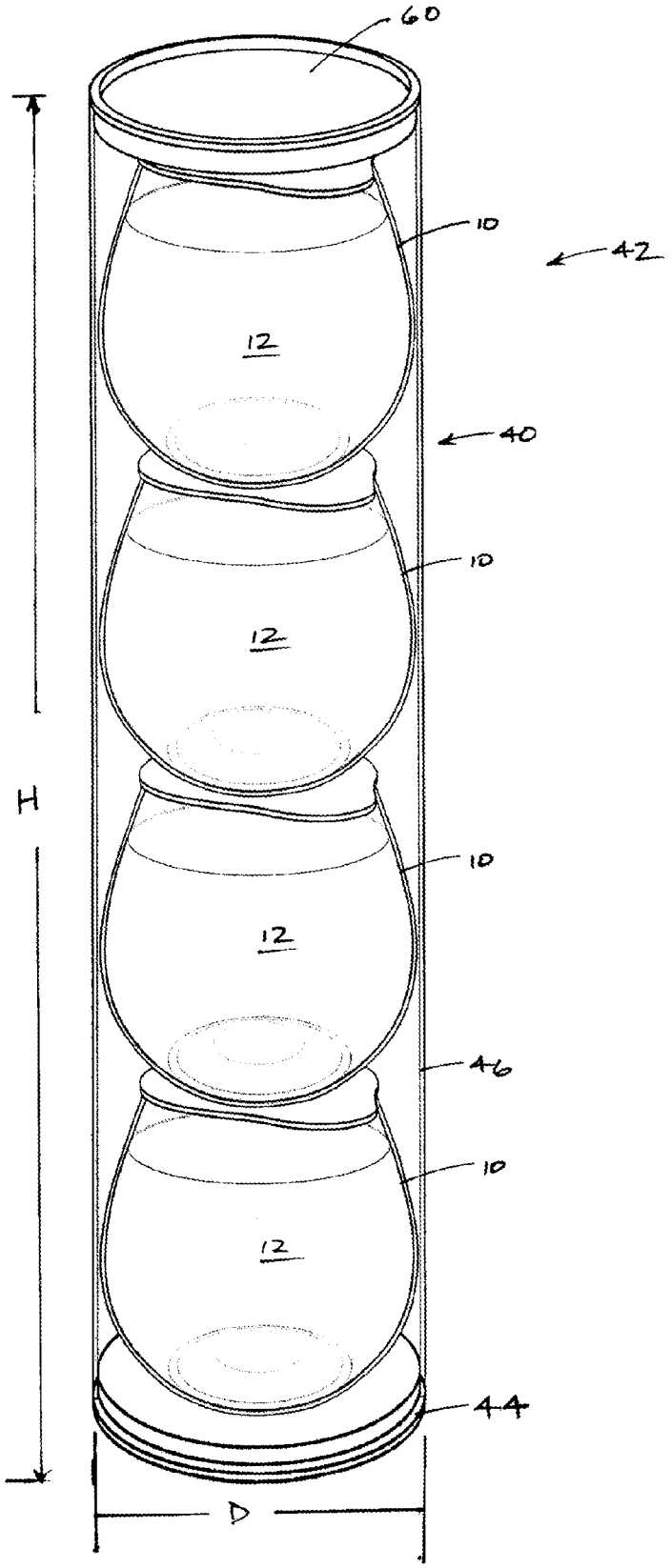
FIG. 3 is a perspective view of a consumer packaged good including a case and a plurality of vessels such as the vessel shown in FIG. 1.

The vessel 10 when sealed by the barrier 30 can be placed inside a case 40 to provide a consumer packaged good 42. With reference to FIG. 3, the consumer packaged good 42 includes the case 40, a plurality of translucent vessels 10*a*, 10*b*, 10*c* and 10*d*, wine 12 stored in each of the plurality of vessels, and the barriers 30 sealed to each vessel for containing the wine in the respective vessel. The case 40 can include a translucent portion and/or can be made from a translucent material, which allows a consumer of the consumer packaged good 42 to see the wine 12 stored within the vessels 10. In other words, the wine 12 can be disposed in a translucent package, e.g. the vessel 10, within a translucent package, e.g. the case 40. If desired, the case 40 and/or the vessels 10 can be tinted a color that is similar to the tinted glass of a conventional wine bottle, e.g. yellow or green. This can provide a very attractive consumer packaged good.

Figure 4:
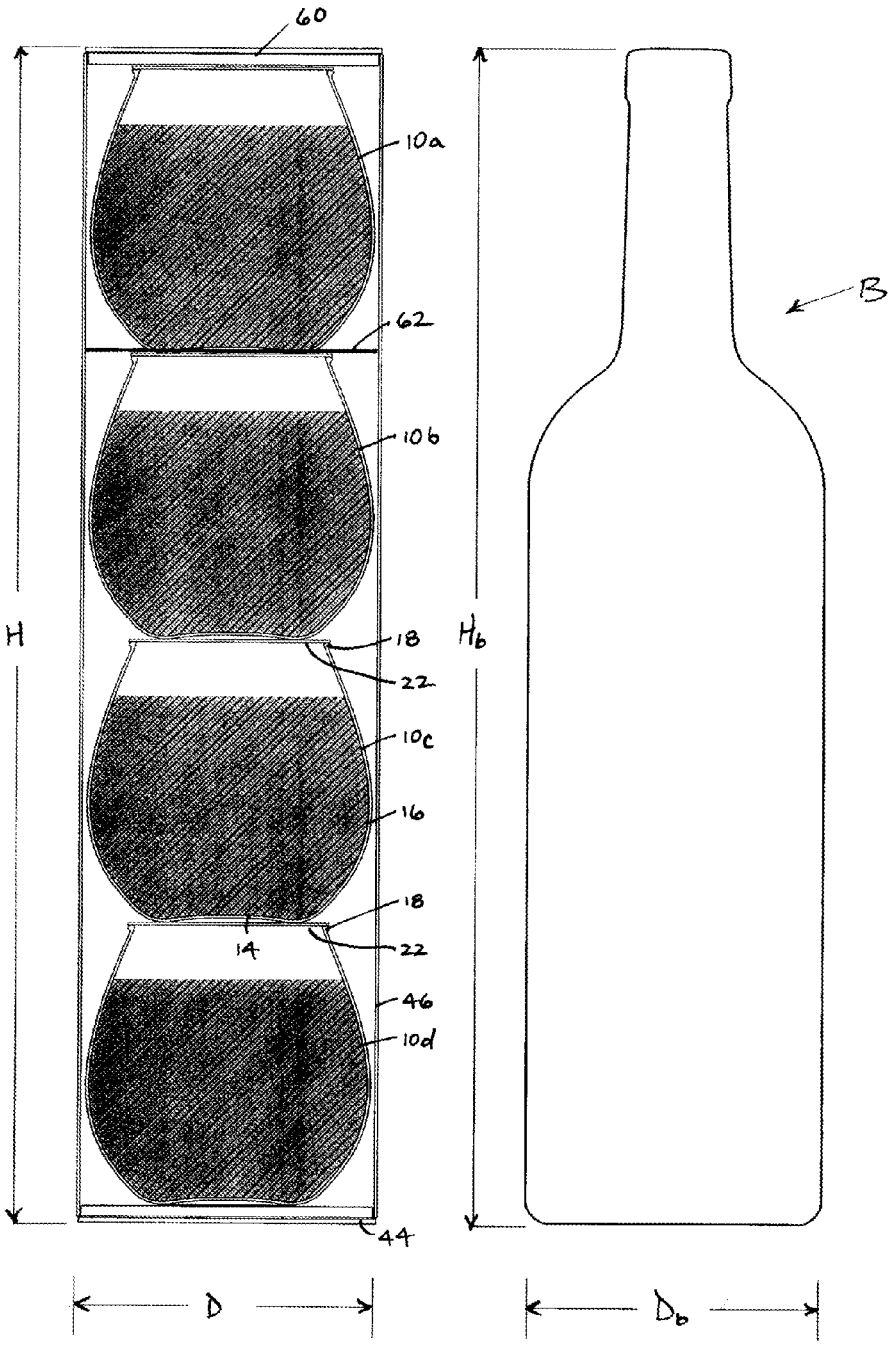
FIG. 4 is a schematic cross-sectional view of the consumer packaged good depicted in FIG. 3 disposed next to a schematic depiction of a conventional 750 ml bottle of wine.

The case 40 includes a base wall 44, at least one side wall 46, and a barrier 60. In the illustrated embodiment, the case 40 includes one side wall 46 that is generally cylindrical in configuration and extends upwardly from adjacent peripheral edge of the base wall 44. The consumer packaged good 42 depicted in FIG. 3 includes four vessels 10 vertically stacked in the case 40. In the embodiment depicted in FIG. 3, each vessel 10 can store about 187 ml of wine so that a total volume of wine for the consumer packaged good 42 is 750 ml, which is similar to the volume of a conventional bottle of wine B (FIG. 4). Accordingly, instead of a consumer purchasing a single 750 ml bottle of wine having four servings that would require resealing if the consumer did not finish the entire bottle, the consumer packaged good 42 provides four individual servings of wine to the consumer. If desired, however, the volume of wine 12 in each vessel can change. For example, three vessels could be packaged in a case where each vessel would contain 250 ml of wine.

The side wall 46 of the case 40 can extend upwardly from the base wall 44 a height H, which can be less than about 13 inches. With reference to FIG. 4, the consumer packaged good 42 is disposed adjacent a conventional 750 ml of wine B. The sidewall 46 of the case 40 extends upwardly from the base wall 44 the height H, which is about equal to or less than the height $H_b$ of a conventional 750 ml bottle of wine. Moreover, the base wall 44 can have a maximum dimension, or diameter, D about equal to or less than the maximum diameter $D_b$ of a conventional 750 ml bottle of wine, which is about three inches. By providing the case 40 with such a configuration, the consumer packaged good 42 has the same footprint on a retail shelf as a conventional 750 ml bottle of wine. This differs from, and provides a significant advantage over, the four-pack bottles of wine described above.

As seen in FIGS. 3 and 4, the consumer packaged good 42 includes four vessels 10*a*, 10*b*, 10*c* and 10*d* vertically stacked, i.e. stacked along an axis coincident or parallel with the vertical axis 26 of each vessel, in the case 40. Accordingly, each barrier 30 and each vessel 10 are configured to support at least three vertically stacked vessels, each storing 187 ml of wine without the barrier 30 unsealing from the vessel 10. Accordingly, the lowermost vessel 10*d* and the respective barrier 30 depicted in FIG. 3 supports the three vessels 10*a*, 10*b* and 10*c* each filled with wine 12, located above the lowermost vessel 10*d*. The barrier 30 on the lowermost vessel 10*d* (as well as the barrier for the remaining vessels 10*a*, 10*b* and 10*c*) should not unseal from the vessel to avoid wine 12 escaping from the lowermost vessel.

As more clearly seen in FIG. 4, each vessel 10 includes the generally circular base 14 and the vessel side wall 16 extending upwardly from the base having the upper edge 18 defining the opening 22. In the embodiment depicted in FIG. 4, the upper edge 18 of the lowermost vessel 10*d* is radially spaced from the base 14 of the vessel 10*c* supported by the barrier 30 of the lowermost vessel. In other words, the base 14 of an upper vessel, e.g. vessel 10*c*, above a lower vessel, e.g. vessel 10*d*, supporting the upper vessel, i.e. vessel 10*c*, does not contact the upper edge 18 of the lower vessel. Accordingly, the barrier 30 should be made of a rigid enough material to support at least three vertically stacked vessels, each storing 187 ml. of wine without having to rely on the side wall 16 of the vessel to carry any of the load.

The consumer packaged good 42 can also include at least one support 62 (depicted schematically in FIG. 4) disposed between adjacent vessels 10. The support 62 contacts the upper edge 18 and the base 14 of adjacent vessels. The support 62 can spread the load of the vessels and transfer the load into the sidewall 16 of vessel 10 below the support. In the illustrated embodiment, the support 62 is a flat disc-like piece that can be made from a rigid material such a paper board, plastic and/or cardboard.

Figure 5:
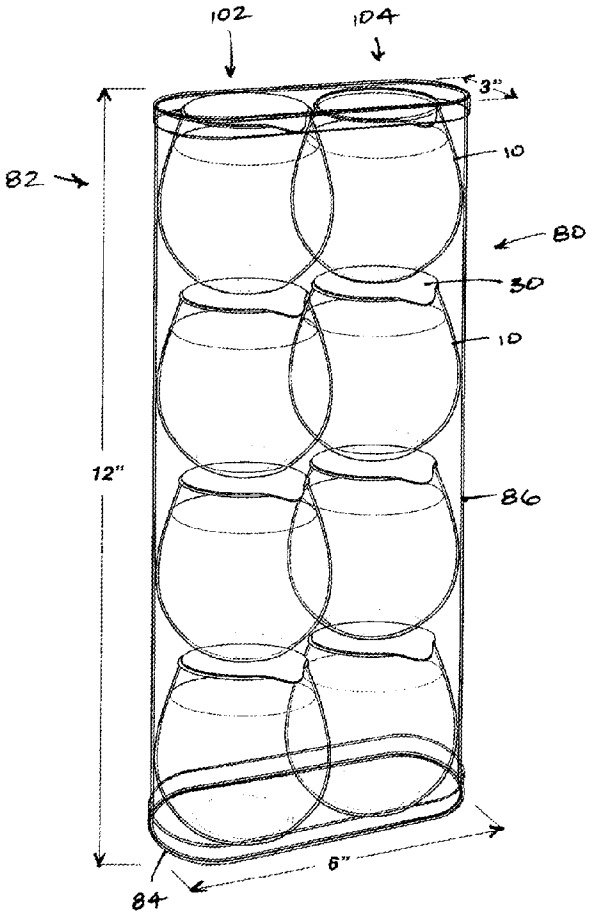
FIG. 5 is an alternative embodiment of a consumer packaged good including a case and a plurality of sealed vessels.

FIG. 5 depicts an alternative embodiment of a case 80 for a consumer packaged good 82. The consumer packaged good 82 includes a plurality of translucent sealed vessels 10 vertically stacked within the case 80. The case 80 includes a base wall 84, at least one side wall 86, and a barrier 100. The consumer packaged good 82 depicted in FIG. 5 includes at least two stacks 102 and 104 of four vessels 10 each. In a similar manner to the case 40 described with reference to FIG. 3, for the case 80, the side wall 86 extends upwardly from the base wall 84 less than about 13 inches and can extend upwardly from the base wall about equal to the height of a conventional 750 ml bottle of wine. Since the consumer packaged good 82 includes at least two stacks 102 and 104 of vessels, the base wall 84 has a maximum dimension about equal to or less than six inches. A second dimension, taken perpendicular to the maximum dimension can be less than or about equal to the diameter of a conventional 750 ml bottle of wine, which is about 3 inches. The dimensions depicted in FIG. 5 are merely exemplary and the dimensions can be different, if desired. Nevertheless, providing dimensions that are similar to those depicted in FIG. 5 can provide a consumer packaged good that provides the consumer the equivalent to two 750 ml bottles of wine in a consumer product where eight servings of wine totaling 1.5 liters of wine are individually provided while only residing in a footprint that is smaller or nearly equal to the footprint for two 750 ml bottles of wine.

The consumer packaged good 82 depicted in FIG. 5 is particularly useful for providing a variety of wines to a consumer in a single package. For example, the first stack 102 of vessels 10 can each store red wine while the second stack 104 of vessels 10 can each store white wine. Each of the vessels 10 stores 187 ml of wine so that the consumer packaged good 82 depicted in FIG. 5 provides a total volume of about 1.5 liters.

Figure 6:
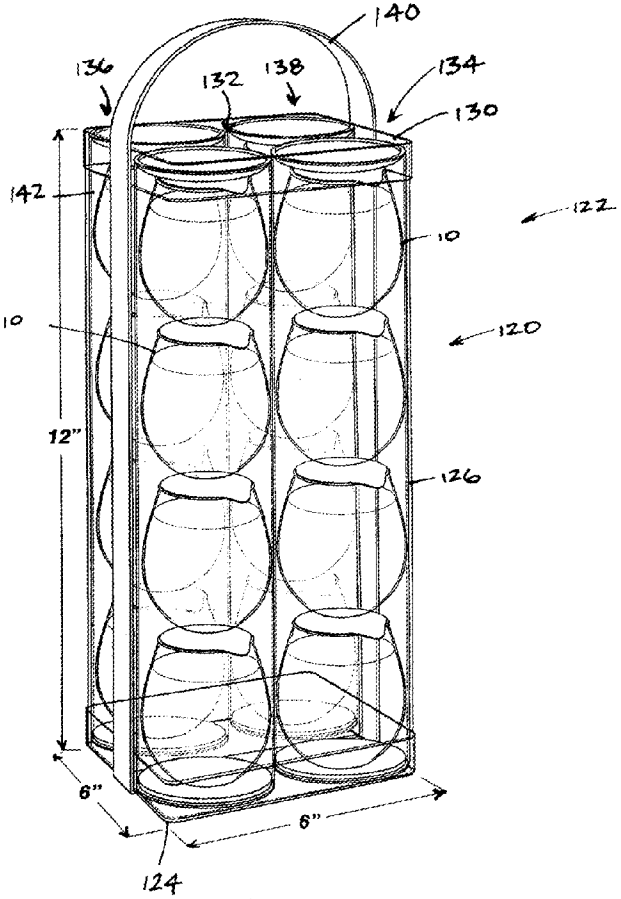
FIG. 6 is another alternative embodiment of a consumer packaged good including a case and a plurality of sealed vessels.
Figure 7:
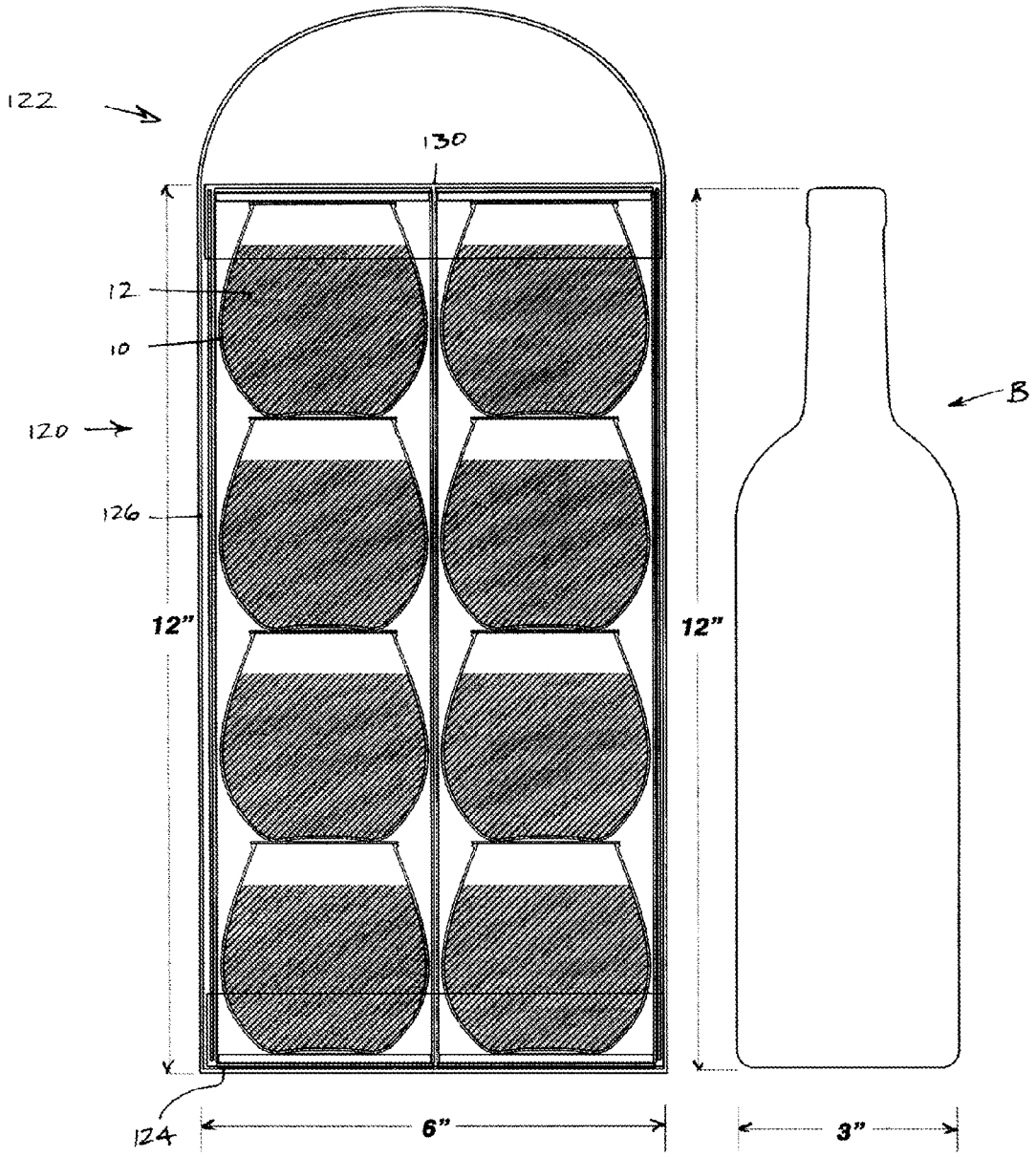
FIG. 7 is a schematic cross-sectional view of the consumer packaged good depicted in FIG. 6 positioned next to a schematic depiction of a conventional 750 ml bottle of wine.

With reference to FIG. 6, a case 120 for an alternative embodiment of consumer packaged good 122 is depicted. The consumer packaged good 122 includes a plurality of translucent sealed vessels 10 vertically stacked within the case 120. The case 120 includes a base wall 124, at least one side wall 126, and a barrier 130. The consumer packaged good 122 depicted in FIG. 6 includes at least four stacks 132, 134, 136 and 138 of four vessels 10 each. In a similar manner to the case 40 described with reference to FIG. 3, for the case 120, the side wall 126 extends upwardly from the base wall 124 less than about 13 inches and can extend upwardly from the base wall about equal to the height of a conventional 750 ml. bottle of wine (see FIG. 7). Since the consumer packaged good 122 includes at least four stacks 132, 134, 136 and 138 of vessels, the base wall 124 has a maximum dimension about equal to or less than six inches. A second dimension, taken perpendicular to the maximum dimension can be less than or about equal to six inches. The dimensions depicted in FIGS. 6 and 7 are merely exemplary and the dimensions can be different, if desired. Nevertheless, providing dimensions that are similar to those depicted in FIGS. 6 and 7 can provide a consumer packaged good that provides the consumer the equivalent to four 750 ml bottles of wine in a consumer product where 16 servings of wine totaling three liters of wine are individually provided while only residing in a footprint that is smaller or nearly equal to the footprint for four 750 ml bottles of wine.

The consumer packaged good 122 depicted in FIG. 6 is also particularly useful for providing a variety of wines to a consumer in a single package. For example, the different stacks of vessels 10 can each include red wine or white wine. Each of the vessels 10 stores 187 ml of wine so that the consumer packaged good 122 depicted in FIG. 6 provides a total volume of about three liters. The consumer packaged good 122 includes a handle 140 attached to the case 120, which facilitates transporting the consumer packaged good. The consumer packaged good also includes vertically oriented dividers 142, which can have a cross-shaped configuration when viewed from above the consumer packaged good 122. The dividers can separate the columns, or stacks 132, 134, 136 and 138 of vessels 10. Fewer or greater than four vessels in each stack can be provided.

Figure 8:
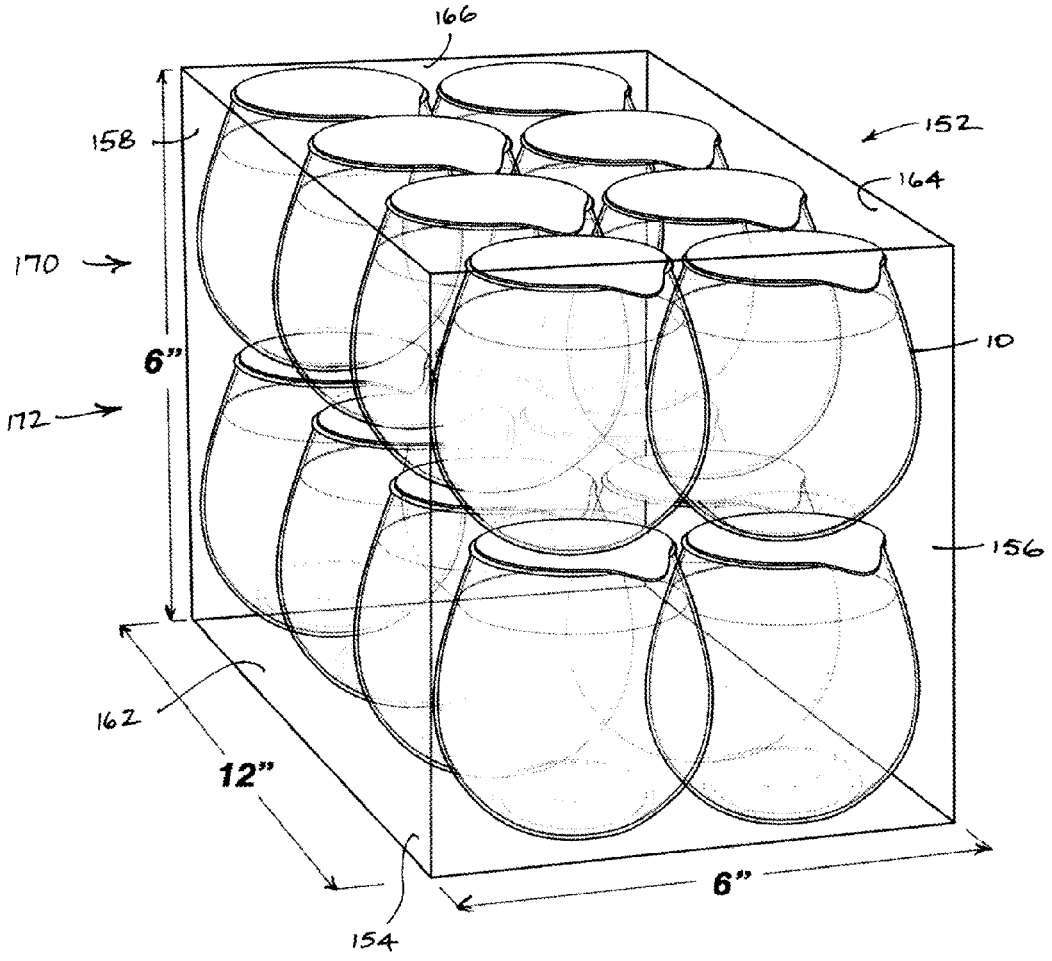
FIG. 8 is another alternative embodiment of a consumer packaged good including a plurality of sealed vessels.
Figure 9:
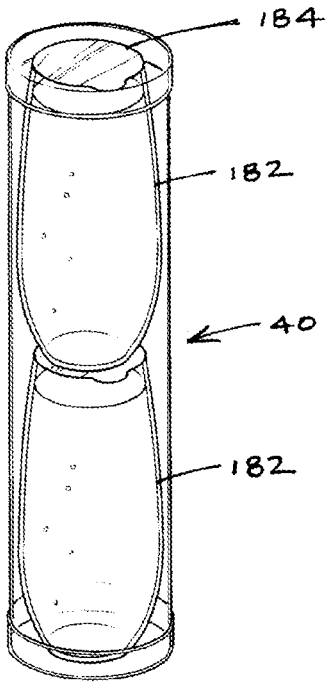
FIG. 9 is a perspective view of an alternative embodiment of a consumer packaged good including a case and a plurality of vessels where the vessels take a different configuration than the vessel shown in FIG. 1.
Figure 10:
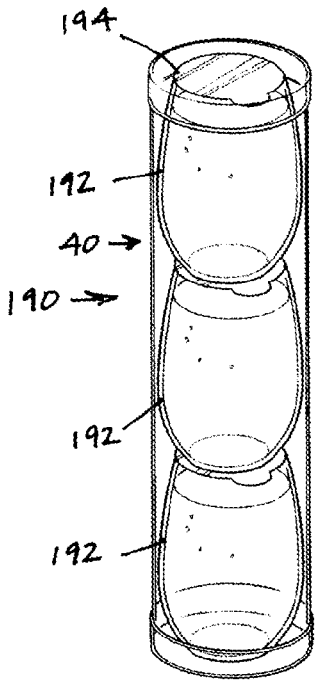
FIG. 10 is a perspective view of another alternative embodiment of a consumer packaged good including a case and a plurality of vessels where the vessels take a different configuration than the vessel shown in FIG. 1.
Figure 11:
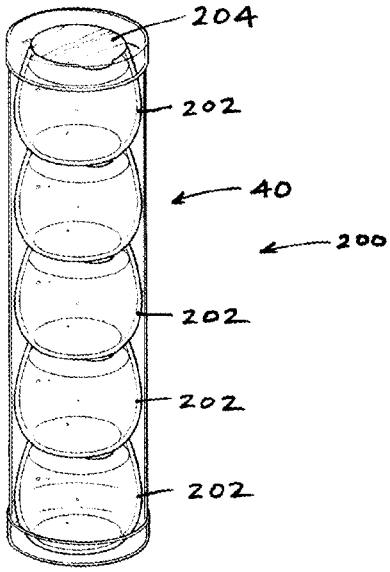
FIG. 11 is a perspective view of another alternative embodiment of a consumer packaged good including a case and a plurality of vessels where the vessels take a different configuration than the vessel shown in FIG. 1.

FIG. 8 depicts another example of a consumer packaged good 150 including a translucent case 152 and a plurality of translucent vessels 10 vertically stacked within the case. In the embodiment depicted at FIG. 8, the translucent case includes a base wall 154 and at least one sidewall which as depicted includes four side walls: a front side wall 156, a rear side wall 158, a left side wall 162, and a right side wall 164. The case 152 also includes a top wall 166. The side walls 156, 158, 162 and 164 extend upwardly from a peripheral edge of the base wall 154. At least one side wall, for example the front sidewall 156 in the illustrated embodiment, having a surface area less than or equal to the remaining sidewalls 158, 162 and 164 is attached to at least one of the remaining sidewalls or the base wall 154 (or the top wall 166) in a manner to allow detachment of the front wall 156 for providing access to the vessels 10. In other words, score lines can be provided either on the front wall 156 or where the front wall connects with an adjacent wall to allow for removal of the front wall from the adjacent wall at the score line to allow for access to the vessels. The case 152 has a maximum dimension less than about 12 inches and a second dimension taken perpendicular to the maximum direction that is less than about six inches, or particularly, a third dimension taken perpendicular to both the first dimension and the second dimension can also be less than about 6 inches. This allows the consumer packaged good 150 to neatly fit inside a conventional U.S. household refrigerator similar to a known 12-pack configurations for cans and beverages.

With continued reference to FIG. 8, a plurality of translucent vessels 10 including an upper layer 170 of vessels vertically stacked on a lower layer 172 of vessels are located within the case 152 and surrounded by the side walls 156, 158, 162 and 164. As with the other embodiments described above, each vessel 10 is shaped similarly to a conventional stemless wine glass.

FIGS. 9-13 depict alternative embodiments of a consumer packaged good. In the embodiment depicted in FIG. 9, the consumer packaged good 180 includes the case 40 (described above in more detail) and two vessels 182 each containing wine and covered by a barrier 184. In the embodiment depicted in FIG. 10, the consumer packaged good 190 includes the case 40 (described above in more detail) and three vessels 192 each containing wine and covered by a barrier 194. In the embodiment depicted in FIG. 11, the consumer packaged good 200 includes the case 40 (described above in more detail) and five vessels 202 each containing wine and covered by a barrier 204. In each of the embodiments depicted in FIGS. 9-11, the vessels take a slightly different configuration so that a total volume of wine within the case is about 750 ml. The vessels 182, 192 and 202 could also be placed into the case 80 (FIG. 5), the case 120 (FIG. 6) or the case 152 (FIG. 8). The number of vessels in the cases can be such that the total volume of wine in the case can be 750 ml, 1.5 liters or three liters.

Figure 12:
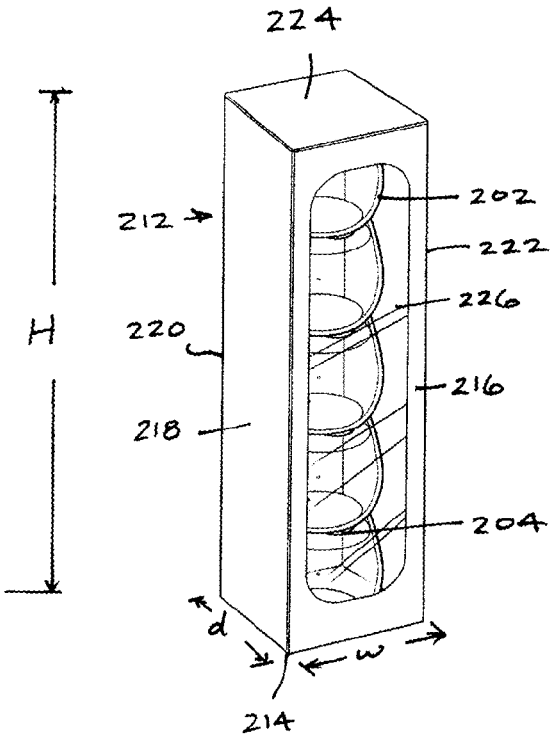
FIG. 12 is a perspective view of another alternative embodiment of a consumer packaged good including a case and a plurality of vessels where the case is different than the cases described with reference to FIGS. 3-11.

In the embodiment depicted in FIG. 12, the consumer packaged good 210 includes a case 212 and five vessels 202 each containing wine and covered by the barrier 204. The case 212 includes a base wall 214, at least one side wall (four side walls 216, 218, 220 and 222), and a barrier 224. In the illustrated embodiment, the case 212 includes a translucent portion 226 through which the vessels 202 are visible. The remainder of the container 212 can be made from an opaque material. The base wall can be rectangular having a width w that is between about 2.75 inches to about 3.5 inches and a depth d that is between about 2.75 inches to about 3.5 inches. The case also has a height H that is between about 12 inches and 13 inches. This allows the case 210 to occupy about the same shelf footprint as a conventional 750 ml bottle of wine. The case 212 shown in FIG. 12 can hold a tolal volume of wine of about 750 ml.

Figure 13:
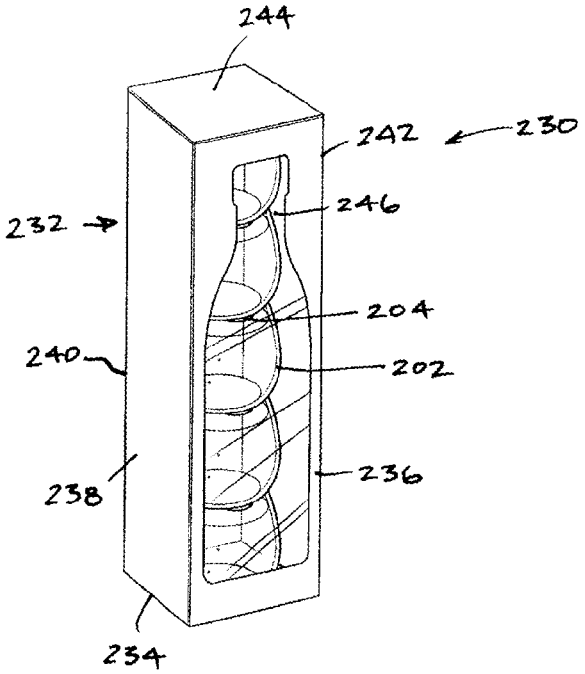
FIG. 13 is a perspective view of another alternative embodiment of a consumer packaged good including a case and a plurality of vessels where the case is different than the cases described with reference to FIGS. 3-11.

In the embodiment depicted in FIG. 13, the consumer packaged good 230 includes a case 232 and five vessels 202 each containing wine and covered by the barrier 204. The case 232 includes a base wall 234, at least one side wall (four side walls 236, 238, 240 and 242), and a barrier 244. In the illustrated embodiment, the case 232 includes a translucent portion 236 through which the vessels 202 are visible. In this embodiment, the translucent portion 246 in on the front side wall 236 and is in the shape of a conventional wine bottle. The remainder of the container 232 can be made from an opaque material. The base wall can be rectangular having a width that is between about 2.75 inches to about 3.5 inches and a depth that is between about 2.75 inches to about 3.5 inches. The case also has a height that is between about 12 inches and 13 inches. This allows the case 232 to occupy about the same shelf footprint as a conventional 750 ml bottle of wine. The case 232 shown in FIG. 12 can hold a total volume of wine of about 750 ml.

Examples of consumer packaged goods that can overcome the problems associated with standard sized wine bottles available on the market today have been described with particularity. Modifications and alterations will occur to those upon reading and understanding the preceding detailed description. For example, the beverage stored in each of the vessels can be changed to an alcoholic beverage other than wine. Also, the cases shown FIGS. 12 and 13 can be enlarged to accommodate more vessels. The appended claims should not be limited to only the embodiments described above, but instead should be broadly construed to include all equivalent structures.

It will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A consumer packaged good comprising:

a plurality of vessels vertically stacked within a package, each vessel includes an opening for drinking from the vessel and a base surface for supporting the vessel on an associated support surface, wherein each vessel defines a vertical axis extending through a center of the opening and generally normal to the base surface and the vessels are stacked along an axis coincident with or parallel to the vertical axis of each vessel;

wine stored in each vessel of the plurality of vessels, wherein each vessel holds an equal volume of wine and the plurality of vessels stores a total volume of wine equal to about 750 ml; and a barrier sealed to each vessel for covering the opening and containing the wine in the respective vessel, wherein the barrier is peelable from the vessel without destroying the vessel to provide access to the wine stored in the vessel, wherein the consumer packaged good has a height equal to or less than about 13 inches measured parallel to the axis coincident with or parallel to the vertical axis of each vessel, wherein the consumer packaged good has a maximum diameter equal to or less than about three inches measured perpendicular to the axis coincident with or parallel to the vertical axis of each vessel.

2. The consumer packaged good of claim 1, wherein each vessel includes a generally circular base and a vessel side wall extending upwardly from the base having an upper edge defining the opening, which is generally circular, wherein the generally circular opening is larger than the generally circular base, and the opening is smaller than a greatest diameter of the vessel, wherein the greatest diameter of the vessel is measured perpendicular to the vertical axis and is less than three inches.

3. The consumer packaged good of claim 1, wherein each vessel is shaped similarly to a stemless wine glass.

4. The consumer packaged good of claim 1, wherein the plurality of vessels includes four vertically stacked vessels.

5. The consumer packaged good of claim 1, wherein the package includes at least one of a translucent portion and an opaque portion.

6. The consumer packaged good of claim 1, wherein the package is a case having a side wall and a base wall extending upwardly from the side wall.

7. The consumer packaged good of claim 6, wherein the side wall of the case is concentric with the vertical axis of each vessel.

8. The consumer packaged good of claim 7, wherein the base wall is circular.

9. The consumer packaged food of claim 8, wherein the side wall is cylindrical.

10. A consumer packaged good comprising:

a plurality of vessels positioned within a package, each vessel includes an opening for drinking from the vessel and a base surface for supporting the vessel on an associated support surface, wherein each vessel defines a vertical axis extending through a center of the opening and generally normal to the base surface, wherein the plurality of vessels are positioned in the package providing at least one stack of vertically stacked vessels and the vessels are stacked along an axis coincident or parallel with the vertical axis of each vessel;

wine stored in each vessel of the plurality of vessels, wherein each vessel holds an equal volume of wine and each stack stores a total volume of wine equal to about 750 ml, wherein the plurality of vessels in the consumer packaged good contains a total volume of wine equal to at least one of 750 ml, 1.5 L and 3L; and a barrier sealed to each vessel for covering the opening and containing the wine in the respective vessel, wherein the barrier is peelable from the vessel without destroying the vessel to provide access to the wine stored in the vessel, wherein the consumer packaged good has a height measured perpendicular to the axis coincident or parallel with the vertical axis of each vessel, wherein the height of the consumer packaged good is equal to or less than about 13 inches, wherein the consumer packaged good has a maximum first dimension measured perpendicular to the height of the consumer packaged good and a maximum second dimension measured perpendicular to the height of the consumer packaged good and to the first dimension, wherein the maximum first dimension is about equal to or less than about three inches when the at least one stack of vertically stacked vessels is one stack or two stacks, wherein the maximum first dimension is about equal to or less than about six inches when the at least one stack of vertically stacked vessels is four stacks, wherein the maximum second dimension is about equal to or less than about three inches when the at least one stack of vertically stacked vessels is one stack, wherein the maximum second dimension is about equal to or less than about six inches when the at least one stack of vertically stacked vessels is two stacks or four stacks.

11. The consumer packaged good of claim 10, when the at least one stack is four stacks of vessels the height of the consumer packaged good is less than about 13 inches, the first dimension is about six inches and the second dimension is about six inches.

12. The consumer packaged good of claim 10, when the at least one stack is two stacks of vessels the height of the consumer packaged good is less than about 13 inches, the first dimension is about three inches and the second dimension is about six inches.

13. The consumer packaged good of claim 10, when the at least one stack is one stack of vessels the height of the consumer packaged good is less than about 13 inches, the first dimension is about three inches and the second dimension is about three inches.

14. The consumer packaged good of claim 10, wherein each stack includes four vertically stacked vessels.

15. The consumer packaged good of claim 10, wherein each vessel includes a generally circular base and a vessel side wall extending upwardly from the base having an upper edge defining the opening, which is generally circular, wherein the opening is smaller than a greatest diameter of the vessel, wherein the greatest diameter of the vessel is measured perpendicular to the vertical axis and is less than three inches.

16. The consumer packaged good of claim 10, wherein each vessel is shaped similarly to a stemless wine glass.

17. The consumer packaged good of claim 10, wherein the package includes at least one of a translucent portion and an opaque portion.

18. The consumer packaged good of claim 10, wherein the package is a case having a base wall and a side wall extending upwardly from the base wall.

19. The consumer packaged good of claim 18, wherein the side wall of the case extends upwardly from the base wall less than 13 inches, and the base wall of the case defines the maximum first dimension and the maximum second dimension.

20. A consumer packaged good comprising:

a plurality of vessels vertically stacked within a package, each vessel includes an opening for drinking from the vessel, wherein each vessel is shaped similarly to a stemless wine glass and defines a vertical axis extending through a center of the opening, wherein the vessels are stacked along an axis coincident with or parallel to the vertical axis of each vessel;

wine stored in each vessel of the plurality of vessels, wherein each vessel holds about 187 ml of wine and the plurality of vessels stores a total volume of wine equal to about 750 ml; and a barrier sealed to each vessel for covering the opening and containing the wine in the respective vessel, wherein the barrier is peelable from the vessel without destroying the vessel to provide access to the wine stored in the vessel, wherein the package has a height measured parallel to the axis coincident with or parallel to the vertical axis of each vessel, wherein the height of the package is equal to or less than about 13 inches, wherein the package has a maximum diameter measured perpendicular to the axis coincident with or parallel to the vertical axis of each vessel, wherein the maximum diameter of the package is about equal to or less than about three inches.

* * * * *